US005253366A

United States Patent [19]

Marlo et al.

[11] Patent Number: 5,253,366

[45] Date of Patent: Oct. 19, 1993

[54] NECKTIE AND SHIRT COMBINATION

[76] Inventors: Maria Marlo, 12 W. 68th St. #5-D, New York, N.Y. 10023; George Spector, 233 Broadway Rm. 3815, New York, N.Y. 10007

[21] Appl. No.: 908,384

[22] Filed: Jul. 6, 1992

[51] Int. Cl.[5] ..... A41D 25/04

[52] U.S. Cl. ..... 2/145; 2/144; 2/155; 2/156; 24/49 R; 24/49 CF; 24/49 KC; 24/54; 24/56

[58] Field of Search ..... 2/144, 145, 148, 149, 2/150, 155, 156, DIG. 6, 130, 137; 63/1.1, 2, 21; 24/58, 49 R, 49 CF, 49 KC, 49 CC, 50, 51, 54, 56, 61

[56] References Cited

U.S. PATENT DOCUMENTS

| | | | |
|---|---|---|---|
| 407,811 | 7/1889 | Bruce | 2/150 |
| 1,588,609 | 6/1926 | Palmer | 2/145 |
| 2,470,973 | 5/1949 | Bovee | 2/145 |
| 2,508,472 | 5/1950 | Scully | 2/145 |
| 2,886,823 | 5/1959 | Kuhlman | 2/145 |
| 3,173,148 | 3/1965 | Horii | 2/145 |
| 3,517,395 | 6/1970 | Shimoi | 2/DIG. 6 |
| 3,639,916 | 2/1972 | Vaughn | 2/145 |
| 4,190,904 | 3/1980 | Nelson | 2/145 |
| 4,723,422 | 2/1988 | Foster | 2/145 |

OTHER PUBLICATIONS

Gershman, Maurice, M.D., "Self-Adhering Nylon Tapes", Journal of The American Medical Assn. vol./68, No. 7, p. 930.

*Primary Examiner*—Clifford D. Crowder
*Assistant Examiner*—Gloria Hale

[57] ABSTRACT

A ready made necktie is provided for a shirt having a collar and a neck band, which consists of the necktie having a knot formed thereon and a mechanism for retaining the knot of the necktie between a front portion of the collar, so that the necktie does not have to extend about the neck band of the shirt to be retained thereto.

1 Claim, 1 Drawing Sheet

NECKTIE AND SHIRT COMBINATION

BACKGROUND OF THE INVENTION

The instant invention relates generally to wearing apparel and more specifically it relates to a ready made necktie which provides a structure for retaining the knot of the necktie at a collar of a shirt.

There are available various conventional wearing apparel which do not provide the novel improvements of the invention herein disclosed.

SUMMARY OF THE INVENTION

A primary object of the present invention is to provide a ready made necktie that will overcome the shortcomings of the prior art devices.

Another object is to provide a ready made necktie that contains a structure for retaining just the knot of the necktie at a collar of a shirt, so that a top button of the shirt can be left opened.

An additional object is to provide a ready made necktie that is of a lesser length than a conventional necktie, since the portion extending about the neck of the wearer is eliminated, thereby saving a considerable amount of material needed in fabricating the necktie.

A further object is to provide a ready made necktie that is simple and easy to use.

A still further object is to provide a ready made necktie that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
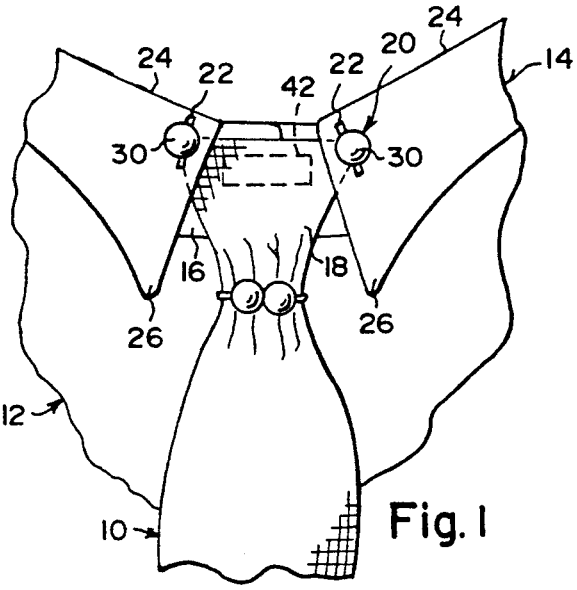
FIG. 1 is a front elevational view of a portion of a shirt with a collar showing a first embodiment of the instant invention being a ready made necktie with ornaments, whereby the necktie is retained to the collar by the ornaments through button holes.

Turning now descriptively to the drawings, in which similar reference characters denote similar elements throughout the several views, the Figures illustrate a ready made necktie 10 for a shirt 12 having a collar 14 and a neck band 16. The necktie 10 has a knot 18 formed thereon and a mechanism 20 for retaining the knot 18 of the necktie 10 between a front portion of the collar 14, so that the necktie 10 does not have to extend about the neck band 16 of the shirt 12 to be retained thereto.

Figure 2:
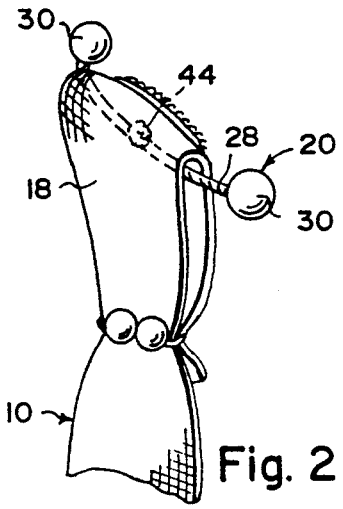
FIG. 2 is a perspective view of the first embodiment per se.
Figure 3:
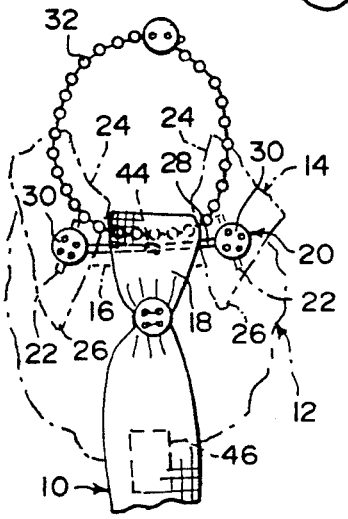
FIG. 3 is a front elevational view of a second embodiment of the instant invention having a neck collar chain.

The retaining mechanism 20, shown in FIGS. 1 to 3, includes the collar 14 having a pair of buttonholes 22, each located in a front side near an upper fold line 24 above a point 26 of the collar 14. An elastic cord 28 extends through the knot 18 of the necktie 10, while a pair of ornaments 30 are each attached to an opposite end of the elastic cord 28. The ornaments 30 can extend through the buttonholes 22 for retaining the knot 18 to the collar 14. In FIG. 3 a neck collar chain 32 extends through the knot 18 of the necktie 10 and about the neck band 16 of the shirt 12 under the collar 14 to help retain the knot 18 thereto.

Figure 4:
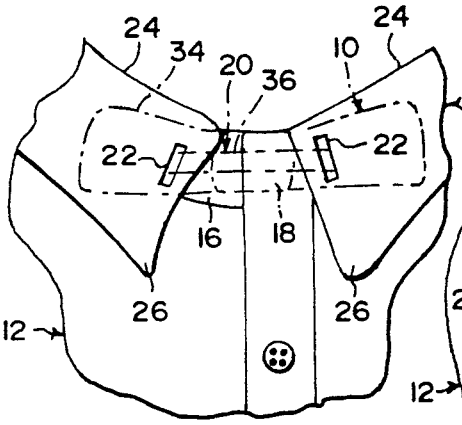
FIG. 4 is a front elevational view of a portion of a shirt with a collar showing a third embodiment of the instant invention in phantom being a bow tie with a snap on clip member through the button holes in the collar.

The mechanism 20 in FIG. 4 includes the collar 14 having a pair of buttonholes 22, each located in a front side near an upper fold line 24 above a point 26 of the collar 14. The necktie 10 is of a bow tie type 34 having a snap-on clip member 36, which will extend through the buttonholes 22 for retaining the knot 18 to the collar 14.

Figure 5:
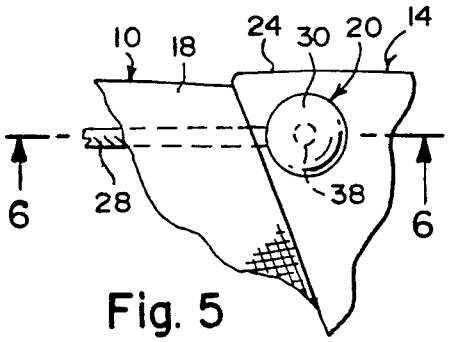
FIG. 5 is a partial front elevational view of a collar and a knot of a fourth embodiment of the instant invention providing a retaining mechanism on the ornament.
Figure 6:
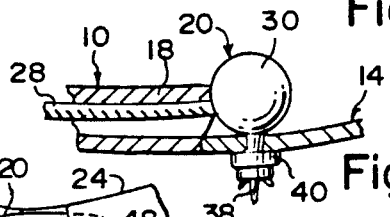
FIG. 6 is a cross sectional view taken along line 6—6 in FIG. 5 showing a friction post and friction nut for retaining the ornament to the collar.

The retaining mechanism 20 in FIGS. 5 and 6 includes an elastic cord 28 to extend through the knot 18 of the necktie 10, while a pair of ornaments 30 are each attached to an opposite end of the elastic cord 28. A pair of friction posts 38 are each affixed to one of the ornaments 30, so that each friction post 38 can pierce the collar 14 in a front side near an upper fold line 24 above a point 26 of the collar 14. A pair of friction nuts 40 are also provided, with each placed onto one friction post 38 for holding the ornament 30 to the collar 14 and retaining the knot 18 thereto.

The ornaments 30 can be balls, as shown in FIGS. 1, 2, 5 and 6 and buttons as shown in FIG. 3. Hoop and loop fabric fasteners 42, shown in FIGS. 1 and 2, can be used to help hold the knot 18 between the front portion of the collar 14. A staple 44 shown in FIGS. 2 and 3, is for attaching the elastic cord 28 to the inside of the knot 18. A money pocket 46 can be sewn into the back of the necktie 10, as shown in FIG. 3, for concealment thereof.

Figure 7:
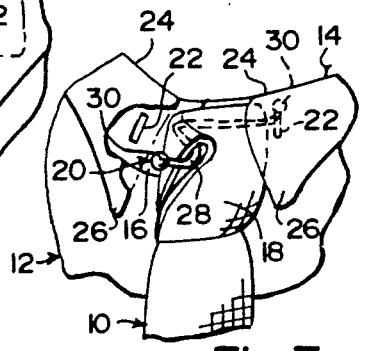
FIG. 7 is a front elevational view of a portion of a shirt with a collar showing a fifth embodiment of the instant invention, in which the buttonholes are in the shirt under the collar.

The retaining mechanism 20 in FIG. 7 consists of the shirt 12 having a pair of buttonholes 22, each located in a front side under the collar 14 near an upper fold line 24 above a point 26 of the collar 14. An elastic cord 28 extends through the knot 18 of the necktie, while a pair of ornaments 30 are each attached to an opposite end of the elastic cord 28. The ornaments 30 can extend through the buttonholes 22 for retaining the knot 18 to the shirt 12.

Figure 8:
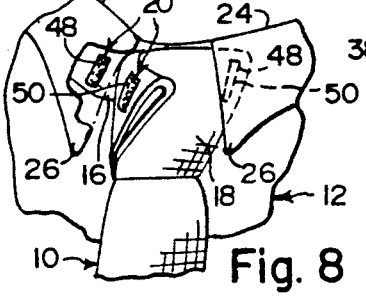
FIG. 8 is a front elevational view of a portion of a shirt with a collar showing a sixth embodiment of the instant invention in which mating VELCRO tabs are on the shirt under the collar and on the back of the knot of the tie.

The retaining mechanism 20 in FIG. 8 consists of the shirt 12 having a pair of hook and loop fasteners or VELCRO tabs 48 attached thereto, with each located in a front side under the collar 14 near an upper fold line 24 above a point of the collar 14. The knot 18 has a pair of mating hook and loop fasteners or VELCRO tabs 50 attached to a rear side thereof for retaining the knot 18 to the shirt 12.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A pre-knotted necktie for a shirt front in combination with a collar with ends and a neck band which comprises:

a) said necktie having a front display portion with a knot formed thereon; and b) means for retaining said knot of said necktie between said collar ends on said shirt front; wherein said retaining means includes:

c) a pair of buttonholes in said collar each located in a front side near an upper fold line above a point of said collar;

d) an elastic cord to extend through said knot of said necktie; and e) a pair of ornaments each attached to an opposite end of said elastic cord, so that said ornaments extends through said buttonholes for retaining said knot to said collar; and further including an neck collar chain extending through said knot of said necktie and about said neck band of said shirt under said collar to help retain said knot thereto.

* * * * *